United States Patent [19]

Boyd et al.

[11] 3,962,661

[45] June 8, 1976

[54] MAGNETICALLY SHUNTED CURRENT TRANSFORMER

[75] Inventors: Robert Kent Boyd, Florissant; Allan Walter Lindberg, St. Louis, both of Mo.

[73] Assignee: International Telephone and Telegraph Corporation, New York, N.Y.

[22] Filed: Apr. 22, 1975

[21] Appl. No.: 570,510

[52] U.S. Cl. ..... 336/84; 336/175; 336/212; 336/219

[51] Int. Cl.[2] ..... H01F 15/04; H01F 27/24

[58] Field of Search ..... 336/210, 212, 234, 219, 336/233, 84, 155, 160, 165, 175, 176, 178

[56] References Cited

UNITED STATES PATENTS

| | | | |
|---|---|---|---|
| 3,478,291 | 11/1969 | Lugten | 336/212 X |
| 3,525,964 | 8/1970 | Stevenson | 336/84 |
| 3,671,903 | 6/1972 | Arrington et al. | 336/210 X |

FOREIGN PATENTS OR APPLICATIONS

| | | | |
|---|---|---|---|
| 1,080,068 | 12/1954 | France | 336/210 |
| 1,024,166 | 2/1958 | Germany | 336/212 |

*Primary Examiner*—Thomas J. Kozma
*Attorney, Agent, or Firm*—James B. Raden; William J. Michals

[57] ABSTRACT

A magnetically shunted current transformer for use with a current carrying conductor, and being of the type having a non-distributed secondary winding is disclosed. The transformer includes a magnetic core comprising first and second separable core sections adapted for placement about the conductor wherein the ends of the sections abut one another to form a substantially continuous core about the conductor. The secondary winding is carried by the continuous core and surrounds a portion of at least one of the sections. A spring bail clamps the core sections together. First and second magnetic shunt members are respectively disposed on opposite sides of the continuous core. Each shunt member comprises a plurality of stacked steel lamina forming a lamination having an elastomeric housing or a jacket molded thereover. The shunt members are provided with a geometry substantially conforming to the continuous magnetic core except at their end portions which confront the secondary winding. Fastening means are provided to removably fasten the shunt members to the continuous core to provide a substantially unitary assembly. Accordingly, the leakage flux is captured by the shunt members thereby allowing a higher conductor current to flow before the transformer saturates; and, thereby, to provide a distributed transformer type operation to closely simulate an ideal current transformer.

4 Claims, 9 Drawing Figures

FIG. 1
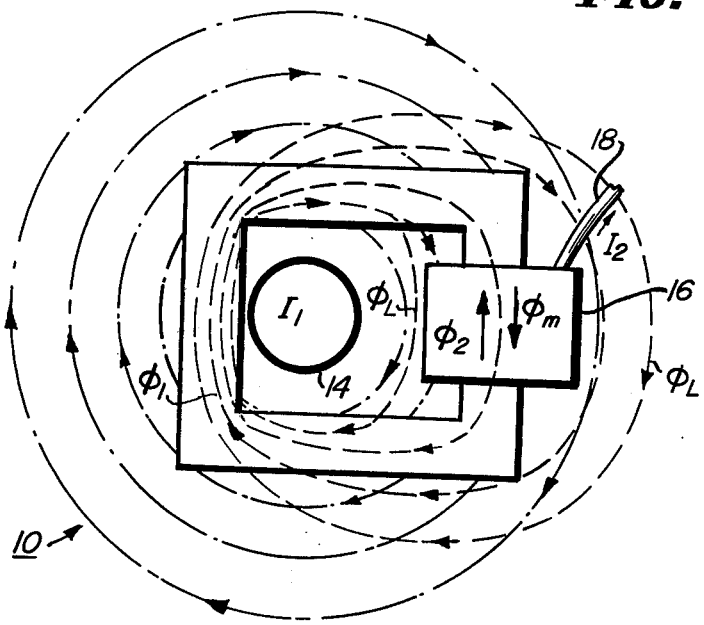
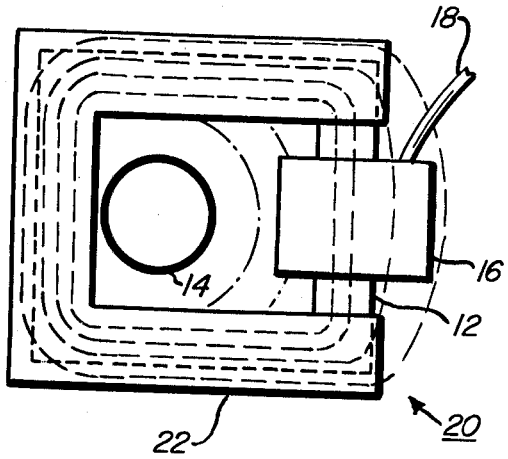
FIG. 2

FIG. 3
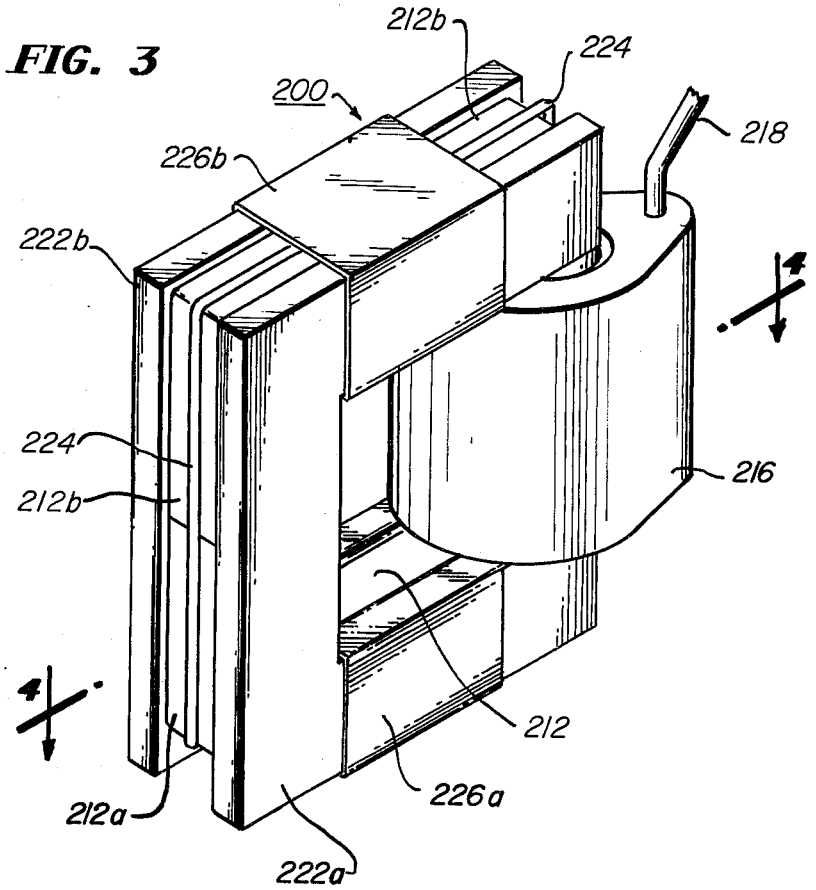
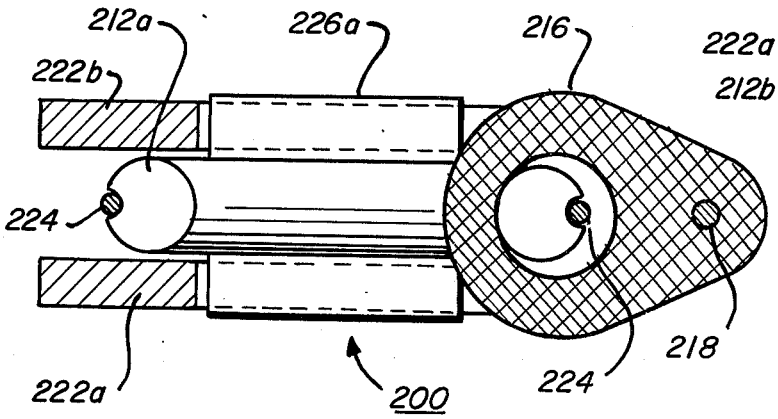
FIG. 4
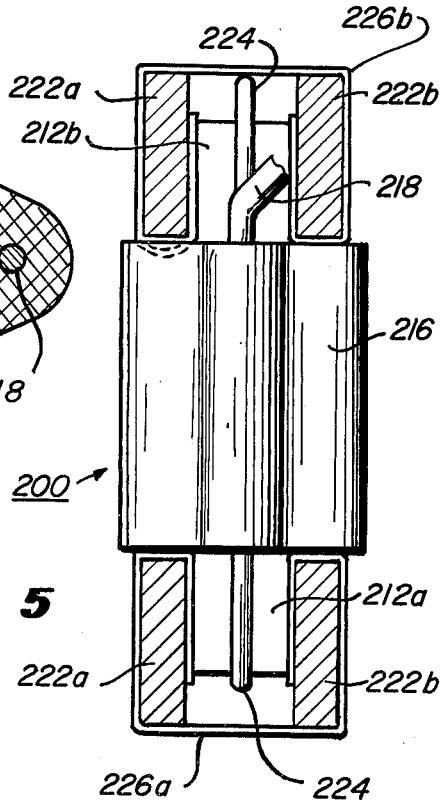
FIG. 5

FIG. 6
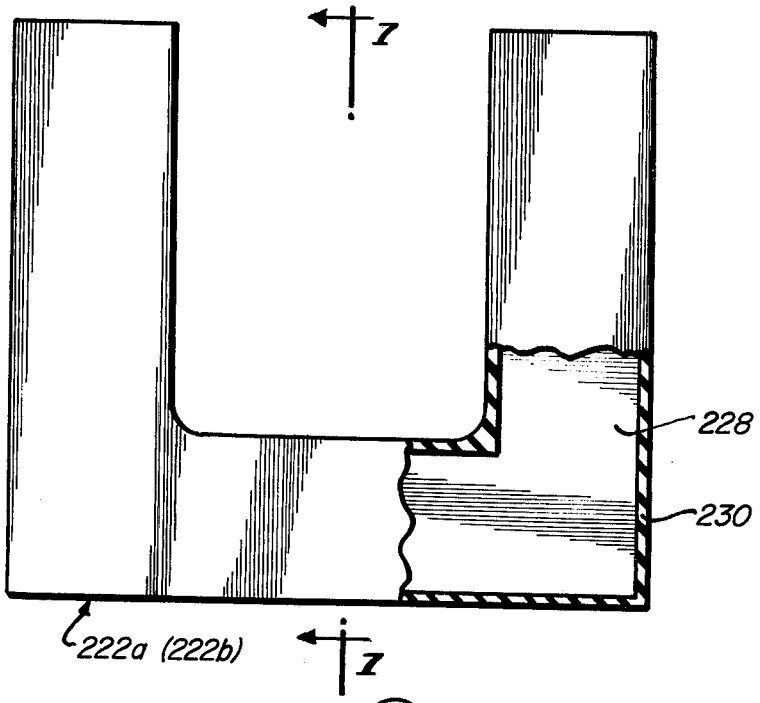
FIG. 8
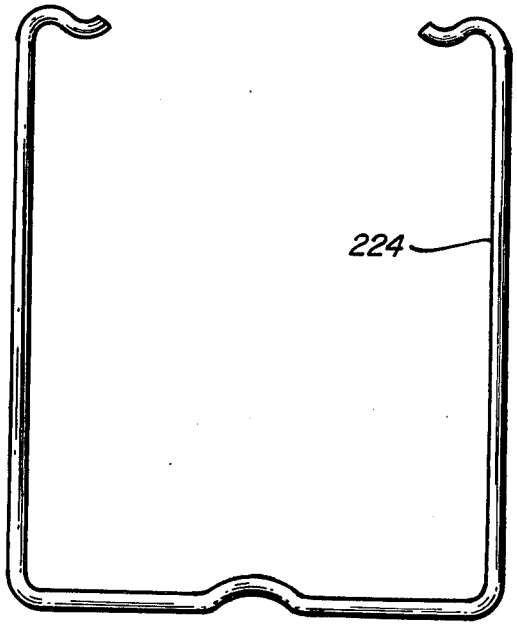
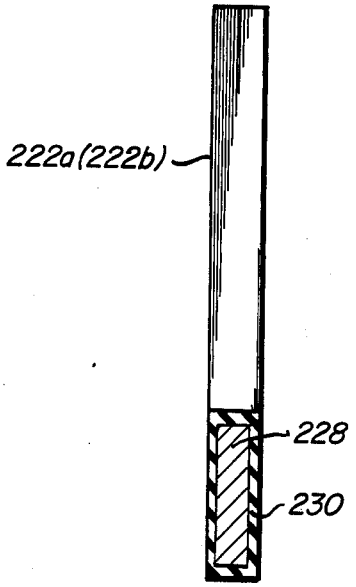
FIG. 7
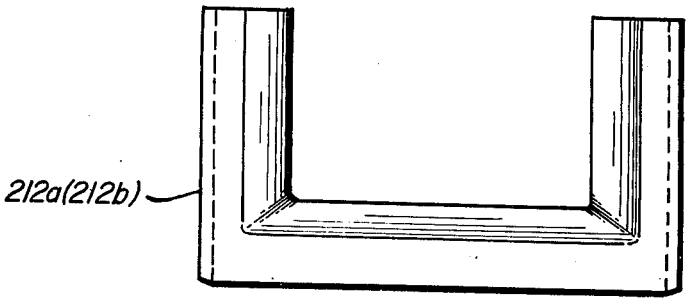
FIG. 9

MAGNETICALLY SHUNTED CURRENT TRANSFORMER

BACKGROUND OF THE INVENTION

This invention relates to a magnetically shunted current transformer and, more particularly, to such a transformer for use with fault current indicators of power line distribution systems.

Current sensing transformers for sensing faults in a power line are well known in the art and generally comprise a pair of generally U-shaped ferrite cores which are mounted about the conductor. The abutting core sections carry a secondary winding which generally takes the form of a bobbin having a bore therethrough for accepting the core and having a multiple-turn winding thereabout. The conductor itself forms the primary winding for the transformer and current flowing through the conductor induces a corresponding current in the secondary or sensing winding. The secondary winding is provided in a "lumped" or non-distributed fashion so as to facilitate installation and removal of the transformer from energized power cables.

However, it has been found that these prior art current transformers saturate at relatively low current levels, are position sensitive and operate in a non-linear manner due to core saturation. These phenomena are due to the fact that leakage flux occurs at the portion of the core which is opposite from the secondary winding. Accordingly, the flux density in this portion of the core is substantially greater than the flux in other portions of the core as well as the transformer secondary itself. Thus, the current transformer core readily saturates and, therefore, the transformer operates non-linearily and is position sensitive to the conductor even though the magnetizing flux inside of the secondary winding is itself well below the saturation level of the core.

These and other disadvantages are overcome by the present invention wherein there is provided a magnetically shunted transformer which functions to recapture this leakage flux thereby allowing substantially higher conductor current levels to flow before transformer saturation occurs. The operation of the transformer in accordance with the present invention approaches that of an ideal current transformer and, accordingly, greater accuracy, range, sensitivity and reliability are achieved.

SUMMARY OF THE INVENTION

Briefly, a magnetically shunted current transformer for use with a current carrying conductor and having a non-distributed secondary winding is provided. The transformer comprises a magnetic core having first and second separable cores adapted for mounting about said conductor so that the end of the sections abut one another to form a substantially continuous core about the conductor and wherein the secondary winding is carried by the magnetic core and surrounds a portion of at least one of the sections. Means are provided for clamping the core sections into abutting and confronting relationship. At least one member of magnetic material having a geometry substantially conforming to the geometry of the continuous magnetic core at its end portions is provided. The end portions of the member abut and confront the secondary winding. Means are provided for fastening the member to the magnetic core to provide a substantially unitary assembly.

BRIEF DESCRIPTION OF THE DRAWING

The advantages of this invention will become more readily appreciated as the same becomes completely understood by reference to the following detailed description when taken in conjunction with the accompanying drawing wherein:

FIG. 1 is a graphic illustration of a prior art current transformer illustrating the attendant leakage flux problem;

FIG. 2 is a graphic representation of the magnetically shunted current transformer, in accordance with the present invention, illustrating the recapturing of the leakage flux and the attendant advantages thereof;

FIG. 3 is a perspective view of a magnetically shunted current transformer in accordance with the present invention;

FIG. 4 is a cross-sectional view of the shunted current transformer taken along the line 4-4 of FIG. 3;

FIG. 5 is an end view of the transformer of FIG. 3, and,

FIGS. 6 – 9 illustrate views of the various component parts of the preferred embodiment of the present invention as depicted herein.

DETAILED DESCRIPTION

FIGS. 1 and 2 are graphic illustrations of conductor line-current transformers useful in explaining the principles of the present invention. For a more detailed discussion of the application of such line-current transformers in a fault indicator system, reference may be had to the co-pending application of R. Boyd and A. Lindberg, Ser. No. 399,080, now U.S. Pat. No. 3,895,296, filed Sept. 19, 1973 and assigned to the same assignee as the present invention.

In FIG. 1 there is shown generally at 10 a current transformer in accordance with the prior art. Transformer 10 includes a core 12 which surrounds and is magnetically coupled to a conductor 14. A coil or secondary winding 16 surrounds one leg of core 12 and has a multiple conductor lead 18 projecting therefrom for connection to external circuit (not shown). The current $I_1$ in conductor 14 provides the primary current for transformer 10 and generates a magnetomotive force $mmf_1$ in core 12. Primary current $I_1$ induces a current $I_2$ in the secondary winding 16 in accordance with the turns ratio between the primary and secondary windings. Current $I_2$ generates a (de-magnetizing) magnetomotive force $mmf_2$ in core 12. The relative signs of $mmf_1$ and $mmf_2$ are different and $mmf_m$ represents the net magnetizing magnetomotive force in the core 12. In an ideal current transformer application $mmf_m$ is essentially zero or very small. The portion of the primary generated flux $\phi_1$ which fails to link secondary winding 16 results in leakage flux $\phi_L$. It can be seen that this leakage flux $\phi_L$ does not link coil 16 and has its highest flux density at the geometric center of the leg of core 12 which is opposite the coil or secondary winding 16. Accordingly, as current $I_1$ continues to increase, core 12 first saturates at this point of flux density concentration. Once core 12 saturates in this region of high flux density, the transformer becomes non-linear and position sensitive in operation.

Referring now to FIG. 2 there is shown a graphic representation of a magnetically shunted current transformer in accordance with the principles of the present invention. Transformer 20 of FIG. 2 further includes a shunt member 22 comprising a material of high permeability such as iron, steel, or other ferrous metal. The geometric configuration of shunt member 22 closely conforms to the geometric configuration of core 12 except at its end portions wherein the pole faces thereat abut and confront secondary winding 16. Means are also provided for mechanically coupling shunt member 22 with core 12. Accordingly, a guided magnetic path is provided wherein the otherwise leakage flux is recaptured, and linked to and with secondary winding 16. This has the effect of reducing the flux density concentration within composite core formed by shunt member 22 and core 12 thereby allowing core 12 to operate at a substantially higher current level before saturation is experienced therein.

Referring now to FIG. 3, there is shown a perspective view of a preferred embodiment of the magnetically shunted current transformer in accordance with the principles of the present invention. Transformer 200 includes a ferrite core 212 comprising two generally U-shaped core halves or sections 212*a* and 212*b*. A secondary winding 216 is provided which may take the form of a wound bobbin, the bore of which receives the end portion of one leg of each of core sections 212*a* and 212*b*, which is enclosed within a protective housing of elastomeric material. The mechanical clamping force which is used to join core sections 212*a* and 212*b* is provided by a suitable fastening means such as a spring or bail 224. Multiple conductor lead 218 is connected internally of secondary winding 216 and extends externally therefrom for connection to external circuit (not shown).

Transformer 200 further includes a pair of magnetic shunt members 222*a* and 222*b* disposed on opposite sides of the assmbled ferrite core. A pair of preferably corrosion resistant spring clips 226*a* and 226*b* provide means for fastening shunt members 222*a* and 222*b* to the ferrite core to complete the assembly. It can be seen by reference to FIG. 4 that the lengths of spring clips 226*a* and 226*b* are selected so as to provide a mechanical stop against secondary winding 216 to further secure the assembly.

As illustrated in FIGS. 6 and 7, which respectively provide a plan view in partial section and an end view in partial section, each shunt member preferably includes a plurality of stacked lamina, formed from steel or any other suitable magnetic material, to provide a lamination 228. The shape of each lamination is selected to closely approximate the geometric configuration of ferrite core 212 and to form the pole faces above and below the secondary coil 216 to recapture and control the otherwise leakage fluxes. Each magnetic shunt member preferably includes a molded elastomeric housing or jacket 230 which functions to control the distance of the lamination 228 from ferrite core 212 and to protect lamination 228, particularly along the edge portions thereof. The elastomeric housing or jacket 230 also provides a frictional surface for engaging spring clips 226*a* and 226*b*. Further, the elastomeric material provides a cushion to protect the relatively fragile ferrite core 212, while providing frictional engagement and pressure thereagainst.

It should be appreciated that the magnetic material of the shunt members may comprise a ferromagnetic or paramagnetic material which need not be a residual magnetic material. In the context of the present specification and the appended claims, the term magnetic material is intended to define a material having a relative magnetic permeability greater than unity. Accordingly, the magnetic material is neither limited to a ferrous ferro-magnetic material, such as iron, nor is it limited to a permanently magnetic material.

FIG. 8 is a front view of spring bail 224 as used herein. In addition to the mechanical clamping or fastening function provided by bail 224, it also provides a starting guide for assembling the component elements of the magnetically shunted current transformer in accordance with the present invention.

Finally, FIG. 9 provides a front view of a typical ferrite core section of the type illustrated in the previous figures. It can be seen that the sections of the ferrite core are provided with slot portions along opposite legs thereof. These slots provide means for receiving and retainingly engaging bail 224. It will be appreciated by those skilled in the art that ferrite core sections of the type illustrated in FIG. 8 are also used as television "fly-back" transformers.

What has been taught, then, is a magnetically shunted current transformer facilitating, notably, a sensing element for fault current indicators of power line distribution systems. The form of the invention illustrated and described herein is but a preferred embodiment of these teachings. It is shown as an illustration of the inventive concepts, however, rather than by way of limitation, and it is pointed out that various modifications and alterations may be indulged in within the scope of the appended claims.

What is claimed is:

1. A magnetically shunted current transformer for use with a current carrying conductor and having a non-distributed secondary winding member, said transformer comprising, in combination:

a magnetic core comprising first and second separable core sections adapted for placement about said conductor wherein the ends of said sections abut one another to form a substantially continuous core and wherein said secondary winding member is carried by said magnetic core and surrounds a portion of at least one of said sections;

means fastening said sections into abutting engagement;

at least one magnetic member having a geometry substantially conforming to said continuous core except at end portions thereof wherein said magnetic number overlaps said core in substantial registry therewith and wherein said end portions of said magnetic member confront said secondary winding; and, means fastening said member with said continuous magnetic core, wherein leakage magnetic flux generated within said continuous core by said current in said conductor is guided by said magnetic member and substantially coupled with said secondary winding.

2. The transformer according to claim 1, including first and second magnetic members respectively disposed on opposite sides of said magnetic core and wherein said means for fastening includes first and second generally U-shaped spring clips respectively disposed at and receiving opposite portions of said first and second magnetic members for urging said first and second magnetic members into engagement with said continuous core.

3. The transformer according to claim 2, wherein said first and second shunt members each comprise a lamination of stacked magnetic lamina and wherein each lamination is enclosed within a housing of molded elastomeric material.

4. The transformer according to claim 3, wherein said laminations are generally U-shaped and wherein each of said spring clips extends along respective leg portions of said laminations to abuttingly and retainingly engage said secondary winding.

* * * * *